US012747639B2

(12) United States Patent
Bilen

(10) Patent No.: US 12,747,639 B2
(45) Date of Patent: Sep. 29, 2026

(54) FIXED NOZZLE PORT RETENTION MECHANISM

(71) Applicant: Baker Hughes Oilfield Operations LLC, Houston, TX (US)

(72) Inventor: Juan Miguel Bilen, The Woodlands, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 19/071,316

(22) Filed: Mar. 5, 2025

(65) Prior Publication Data

US 2026/0266143 A1 Sep. 10, 2026

(51) Int. Cl.
*E21B 10/61* (2006.01)

(52) U.S. Cl.
CPC ..... *E21B 10/61* (2013.01)

(58) Field of Classification Search
None
See application file for complete search history.

(56) References Cited

U.S. PATENT DOCUMENTS 2,721,058 A * 10/1955 Boice ..... E21B 10/61 175/315
3,548,959 A * 12/1970 Hasiba ..... E21B 10/60 175/426
3,551,981 A * 1/1971 Hagar ..... E21B 10/61 403/240
3,688,852 A * 9/1972 Gaylord ..... E21B 7/18 285/390
3,838,742 A * 10/1974 Juvkam-Wold ..... E21B 10/60 175/380
4,542,798 A * 9/1985 Madigan ..... E21B 10/61 175/393
7,954,568 B2 * 6/2011 Bilen ..... E21B 10/61 175/429
2017/0204675 A1 * 7/2017 Yu ..... E21B 10/61
2022/0307326 A1 * 9/2022 Bilen ..... E21B 10/61
2022/0389765 A1 * 12/2022 Morin ..... E21B 10/14

OTHER PUBLICATIONS

"Bakerlock Thread Locking Compound", bakerlok.com, as it appeared on Feb. 24, 2024, accessed via web.archive.org (Year: 2024).*
Dictionary definition of "epoxy", accessed via thefreedictionary.com.*
Dictionary definition of "channel", accessed May 7, 2026 via thefreedictionary.com.*

* cited by examiner

*Primary Examiner* — Blake Michener
(74) *Attorney, Agent, or Firm* — TraskBritt

(57) ABSTRACT

A method of forming an earth-boring tool includes providing a drill bit body with a nozzle cavity adapted to receive a nozzle and forming a first groove in the wall of the nozzle cavity at a first depth. A nozzle adapted to be inserted into the nozzle cavity is also provided. A second groove is formed in the nozzle at a second depth. The nozzle is inserted into the nozzle cavity such that the first groove and the second groove are aligned. A sealant is provided and cured on the interior of the nozzle cavity and/or the exterior of the nozzle.

19 Claims, 14 Drawing Sheets

FIXED NOZZLE PORT RETENTION MECHANISM

TECHNICAL FIELD

Embodiments of the present disclosure generally relate to earth-boring operations. In particular, embodiments of the present disclosure relate to earth-boring tool geometry, nozzle placement and installation, and associated apparatus and methods.

BACKGROUND

Wellbore drilling operations may involve the use of an earth-boring tool at the end of a long string of pipe commonly referred to as a drill string. An earth-boring tool may be used for drilling through formations, such as rock, dirt, sand, tar, etc. In some cases, the earth-boring tool may be configured to drill through additional elements that may be present in a wellbore, such as cement, casings (e.g., a wellbore casing), discarded or lost equipment (e.g., fish, junk, etc.), packers, etc. In some cases, earth-boring tools may be configured to drill through plugs (e.g., fracturing plugs, bridge plugs, cement plugs, etc.). In some cases, the plugs may include slips or other types of anchors and the earth-boring tool may be configured to drill through the plug and any slip, anchor, and other component thereof.

Earth-boring tools may include cutting structures formed from abrasive materials having high hardness characteristics. The cutting structures may be configured to engage the formations and additional elements removing material therefrom. As the cutting structures engage the formations and additional elements, debris (e.g., chips, cuttings, loose material, etc.) and significant amounts of heat may be generated. If the debris and heat are not dissipated, they may contribute to premature failure of the cutting structures requiring the earth-boring tool to be removed for repair and or replacement. This may result in significant loss of time reducing the efficiency and increasing the costs of a drilling operation.

A fluid may be supplied into the wellbore during the wellbore drilling operation. The fluid may be used to cool and/or clean the earth-boring tool and/or related cutting elements. For example, the fluid may cool the earth-boring tool and carry cuttings and debris away from the earth-boring tool. The fluid is pumped down the borehole to the bottom hole apparatus (BHA) through the drill bit and out of the drill bit through outlets in the drill bit. One common type of outlet is a nozzle attached to the drill bit via a nozzle cavity. Nozzles may be secured to the drill bit body in various ways. In some cases, the nozzle is a simple cylinder that is brazed to the drill bit.

BRIEF SUMMARY

Embodiments of the present disclosure may include a method of forming an earth-boring tool. The method may include providing a drill bit body with a nozzle cavity adapted to receive a nozzle and forming a first groove in a wall of the nozzle cavity at a first depth. A nozzle adapted to be inserted into the nozzle cavity is also provided. A second groove is formed in the nozzle at a second depth. The nozzle is inserted into the nozzle cavity such that the first groove and the second groove are aligned. A sealant is provided and cured on the interior of the nozzle cavity and/or the exterior of the nozzle.

Another embodiment of the present disclosure may include an earth-boring tool. The earth-boring tool may include a drill bit body having at least one blade and at least one nozzle cavity. The nozzle cavity includes a generally tubular shape, and the nozzle cavity has a first groove formed on an interior surface thereof. A nozzle is disposed in the nozzle cavity. The nozzle includes a generally cylindrical shape and has a second groove formed on an external surface thereof. The second groove may at least partially overlap the first groove. The first groove and the second groove form a space between the nozzle and the nozzle cavity. A sealant is disposed in the space between the nozzle cavity and the nozzle.

Another embodiment of the present disclosure may include a drill bit. The drill bit may include a plurality of blades, cutting elements disposed on the blades, and fluid courses disposed between the plurality of blades. A first outlet may be disposed in a first fluid course of the fluid courses and a second outlet may be disposed in a second fluid course of the fluid courses. A fixed port nozzle may be disposed in the first outlet. The first outlet defines a nozzle cavity, and the fixed port nozzle may be disposed in the nozzle cavity. A sealant may be disposed between an outer surface of the fixed port nozzle and an inner surface of the nozzle cavity. The sealant bonds the fixed port nozzle to the nozzle cavity. The sealant may be an epoxy or a monomer. A removeable nozzle may be disposed in the second outlet.

BRIEF DESCRIPTION OF THE DRAWINGS

For a detailed understanding of the disclosure, reference should be made to the following detailed description, taken in conjunction with the accompanying drawings, in which like elements have generally been designated with like numerals, and wherein.

DETAILED DESCRIPTION

Figure 1A:
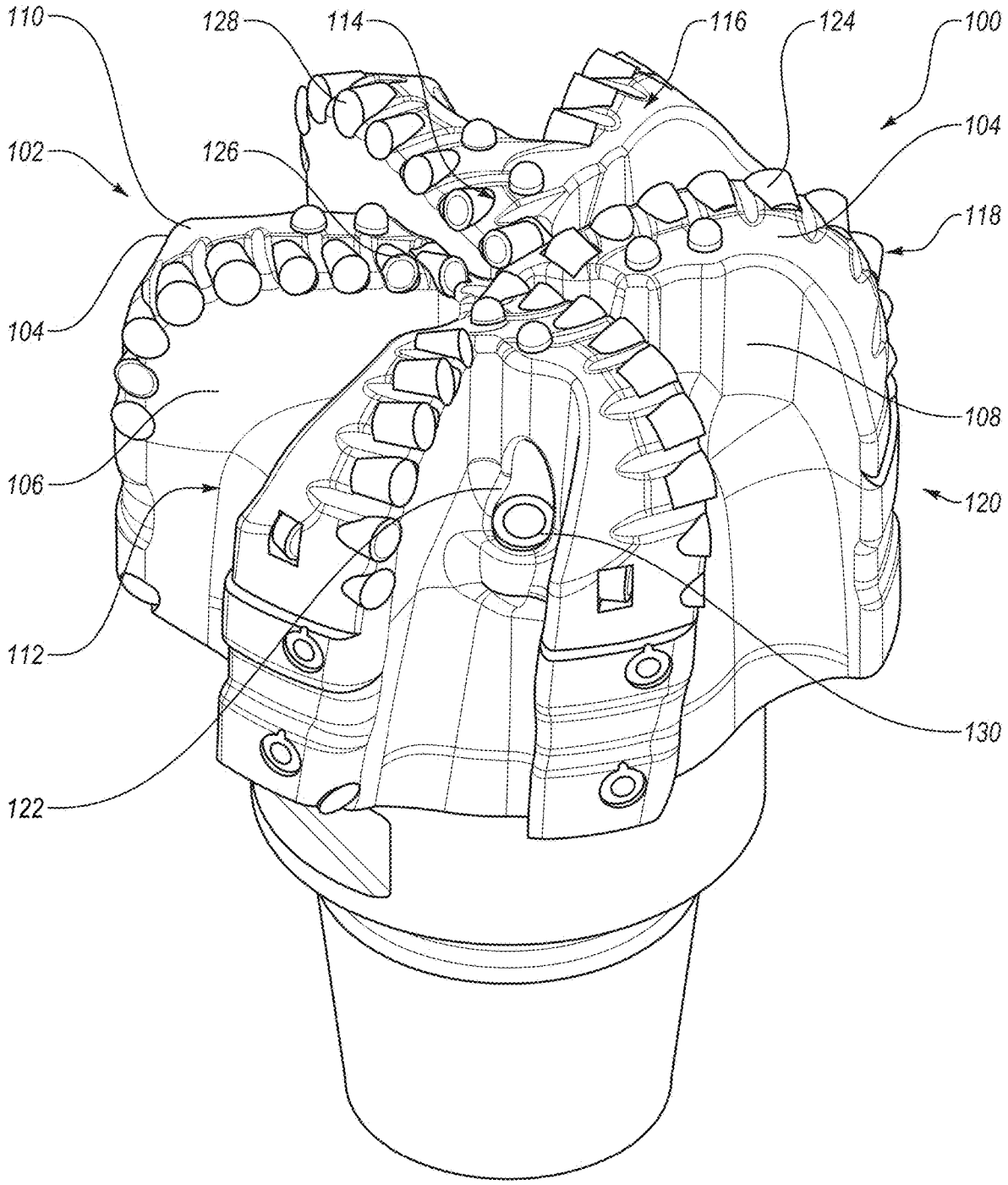
FIG. 1A is a side perspective view of an earth-boring tool in accordance with embodiments of the present disclosure.

The illustrations presented herein are not meant to be actual views of any particular earth-boring system or component thereof, but are merely idealized representations employed to describe illustrative embodiments. The drawings are not necessarily to scale.

As used herein, the term "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, at least about 99% met, or even at least about 100% met.

As used herein, the term "about" or "approximately" in reference to a numerical value for a particular parameter is inclusive of the numerical value and a degree of variance from the numerical value that one of ordinary skill in the art would understand is within acceptable tolerances for the particular parameter. For example, "about" or "approximately" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, terms such as "ahead" and "behind" are used in reference to a direction of movement of the associated element. For example, as a drill string moves into a borehole the bottom of the borehole is ahead of the elements of the drill string and the surface is behind the elements of the drill string. In another example, in relation to a cutting element on a rotating earth-boring tool, a portion of the formation that has not yet been contacted by the cutting element is ahead of the cutting element whereas a portion of the formation that has already been contacted by the cutting element is behind the cutting element. Also, in relation to components on a rotating earth-boring tool, a component of the earth-boring tool (e.g., a blade or cutting element) is ahead of other components and behind some other components relative to the direction of rotation and any given point in the wellbore (e.g., every blade is ahead of at least one blade and behind at least one other blade).

As used herein, the term "and/or" means and includes any and all combinations of one or more of the associated listed items.

Fixed port nozzles are typically used in drill bits when no total flow area (TFA) changes are expected in the bit and/or when it is not possible to accommodate other nozzles due to limited space. Fixed port nozzles require a permanent retention mechanism to keep the nozzle in place during drilling operations. Fixed port nozzles are typically attached by brazing, but this has proven ineffective due to the difficulty of brazing components in large body tools and uneven distribution of the brazing alloy around the parts. The uneven distribution of the brazing alloy also contributes to incomplete seals and leaks. Due to incomplete bonding, problems such as hydraulic leaks, washout, and lost nozzles are common with brazed fixed port nozzles leading to lost productivity and increased drilling costs.

The present disclosure provides a method for securing a fixed port nozzle that provides a better seal between the tool bit and nozzle reducing leaks, washouts, and lost nozzles, thereby reducing non-productive time (NPT) and improving overall rate of penetration (ROP) of the drilling operation. The nozzles may also readily be removed and replaced and/or re-installed during standard drill bit repair procedures as the temperatures necessary for removing and replacing cutting elements are high enough to break down the sealant bonding the parts.

Figure 1B:
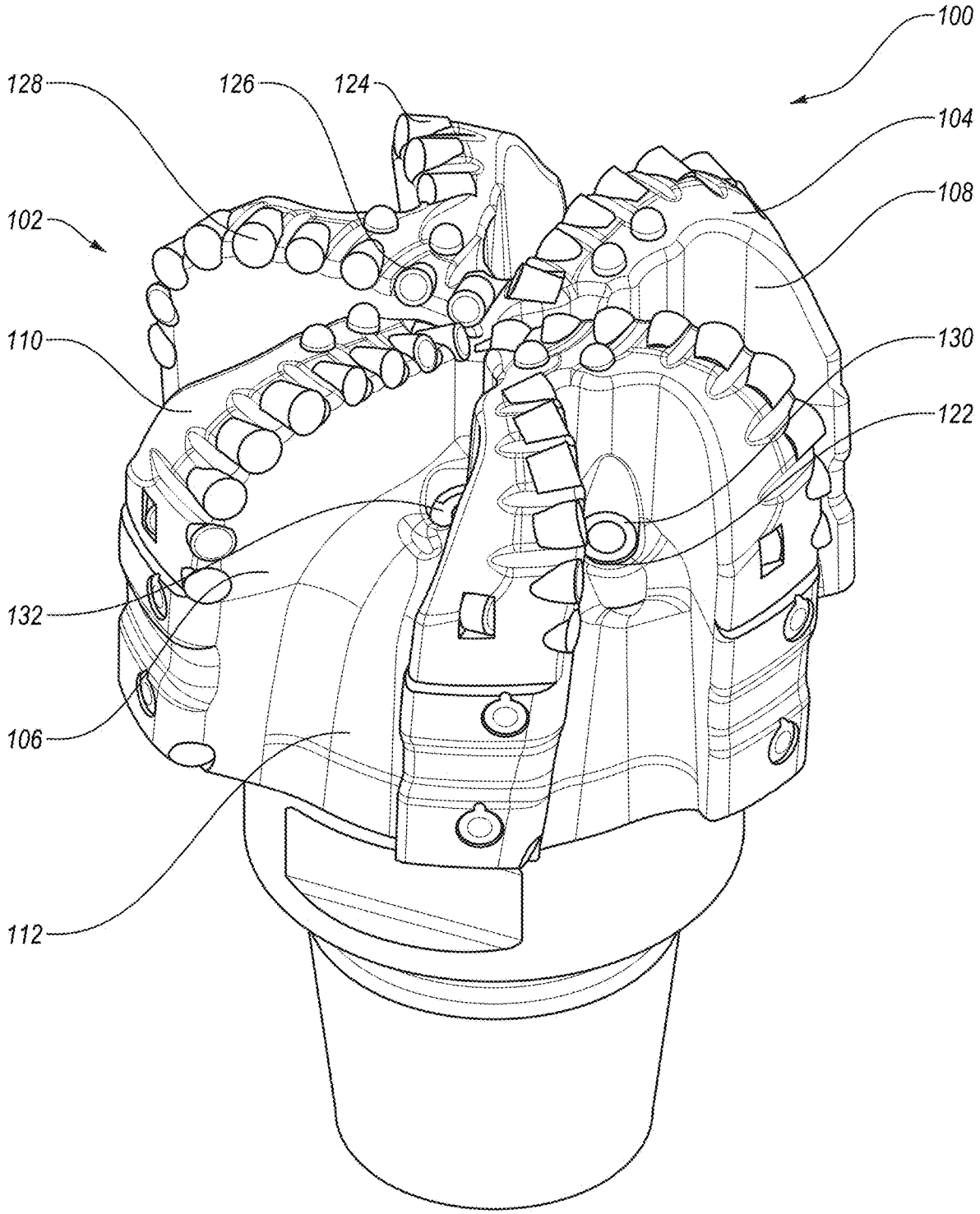
FIG. 1B is another side perspective view of the earth boring tool shown in FIG. 1A.
Figure 1C:
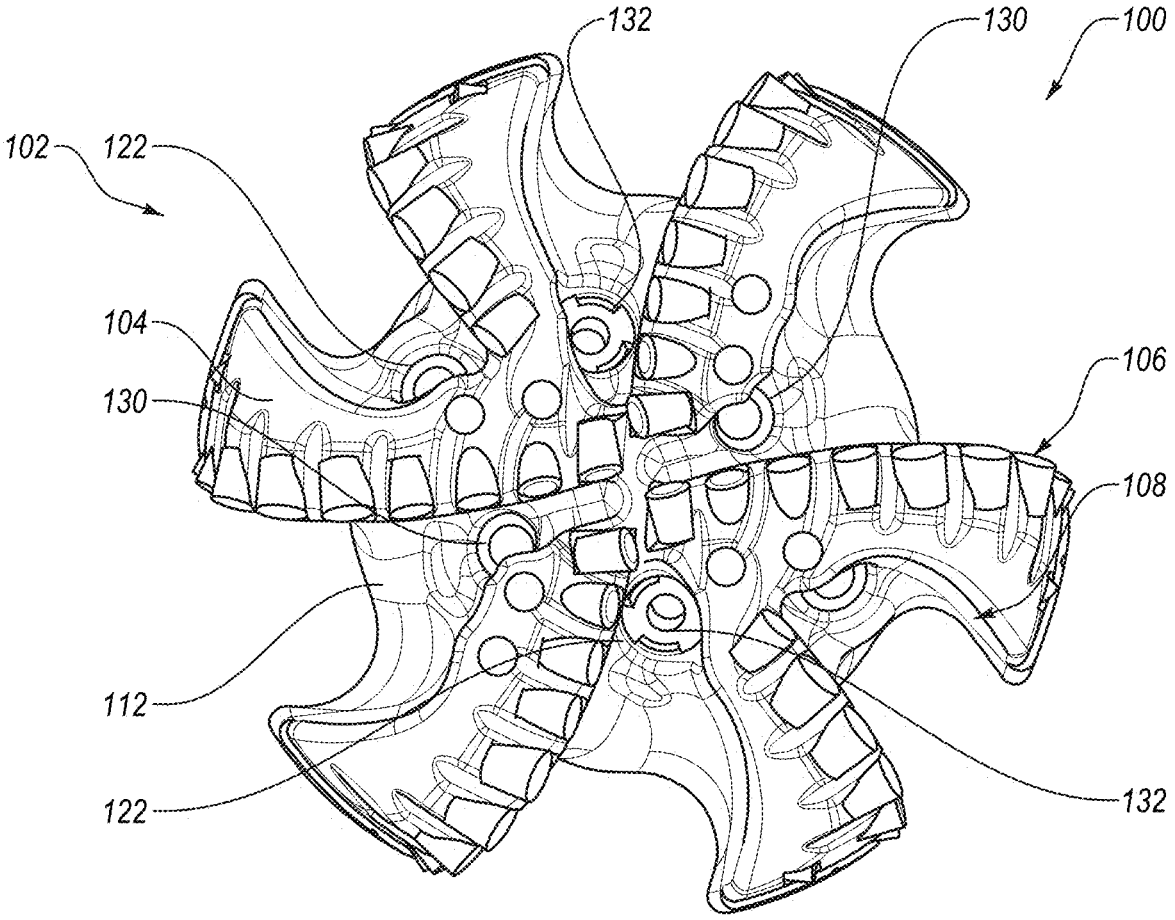
FIG. 1C is a top view of the earth boring tool shown in FIG. 1A.

FIG. 1A, FIG. 1B, and FIG. 1C illustrate an earth-boring tool according to embodiments of the present disclosure. The earth-boring tool is a fixed-cutter type rotary drill bit 100, which includes a bit body 102 having radially protruding and longitudinally extending blades 104 thereon. The bit body 102 may be secured to a steel shank (not shown), which is used to couple the drill bit 100 to the end of a drill string. The bit body 102 of the drill bit 100 may be formed from steel. Alternatively, the bit body 102 may be formed from a particle-matrix composite material. Such materials include hard particles randomly dispersed throughout a matrix material (often referred to as a "binder" material). Such bit bodies 102 typically are formed by embedding a steel blank in a volume of particulate carbide material (e.g., tungsten carbide, titanium carbide, tantalum carbide, etc.) within a graphite mold and infiltrating the particulate carbide material with a matrix material, such as a copper-based alloy. Drill bits that have a bit body formed from such a particle-matrix composite material may exhibit increased erosion and wear resistance, but lower strength and toughness relative to drill bits having steel bit bodies.

The blades 104 have a rotationally leading surface 106, a rotationally trailing surface 108 opposite the rotationally leading surface 106, and a radially outer formation-facing surface 110. The rotationally leading surface 106 of a first blade, the rotationally trailing surface 108 of another blade, and the bit body 102 between them together define a fluid course 112. As is known in the industry, the bit body 102 includes different regions referred to as the cone region 114, the nose region 116, the shoulder region 118, and the gage region 120. A longitudinal bore (not shown) extends through the steel shank and partially through the bit body 102, and fluid passageways (not shown) extend through the bit body 102 between the longitudinal bore and outlets 122 located in the bit body 102 at distal ends of the fluid courses 112 to discharge fluid to cool the drill bit 100 and to entrain and remove cuttings and debris from the wellbore.

A plurality of cutting elements 124 are secured to each of the blades 104 close to the junction between the rotationally leading surface 106 and the formation-facing surface 110 and/or on the formation-facing surface 110. The cutting elements 124 are equipped with a hard, abrasive cutting table 126. The cutting elements 124 may be, for example, polycrystalline diamond compact (PDC) cutting elements, which have a diamond table disposed on a cemented tungsten carbide substrate. Each cutting element 124 may be secured to the blade within a cutting pocket formed in the blade 104, such as through welding, soldering, brazing, etc. In various embodiments, the cutting elements 124 on the earth-boring tool may have a cutting table 126 with a cutting face 128 adapted to cut into a formation and produce cuttings.

In accordance with embodiments of the present disclosure, the drill bit 100 may comprise one or more fixed port nozzles 130 and/or one or more removeable nozzles 132 installed at the outlets 122 of the bit body 102. The outlets 122 and the fixed port nozzles 130 or the removeable nozzles 132 are in fluid communication with a source of drilling fluid which is pumped into and through the fixed port nozzles 130 and/or the removeable nozzles 132 into the well bottom to cool the cutting elements 124 and remove debris, such as cuttings, from the wellbore.

During drilling operations, the drill bit 100 is positioned at the bottom of a wellbore and rotated about a longitudinal axis while drilling fluid is pumped down the drill string to the longitudinal bore and through internal fluid passageways (not shown) to the fixed port nozzles 130 and/or the removeable nozzles 132. When the drill bit 100 rotates, the cutting face 128 of the cutting elements 124 may contact the earth formation and remove material. The material removed by the cutting face 128 may then be removed through the fluid courses 112. In the industry, the portion of the fluid courses 112 in a gage region 120 of the drill bit 100 are commonly referred to as junk slots. The fixed port nozzles 130 and the removeable nozzles 132 may be disposed within the fluid courses 112 which may introduce fluid, such as water or drilling mud, into the area around the blades 104 to aid in removing the sheared material and other debris from the area around the blades 104 and/or to cool the cutting elements 124 and the blades 104 to increase the longevity and efficiency of the drill bit 100.

Figure 2:
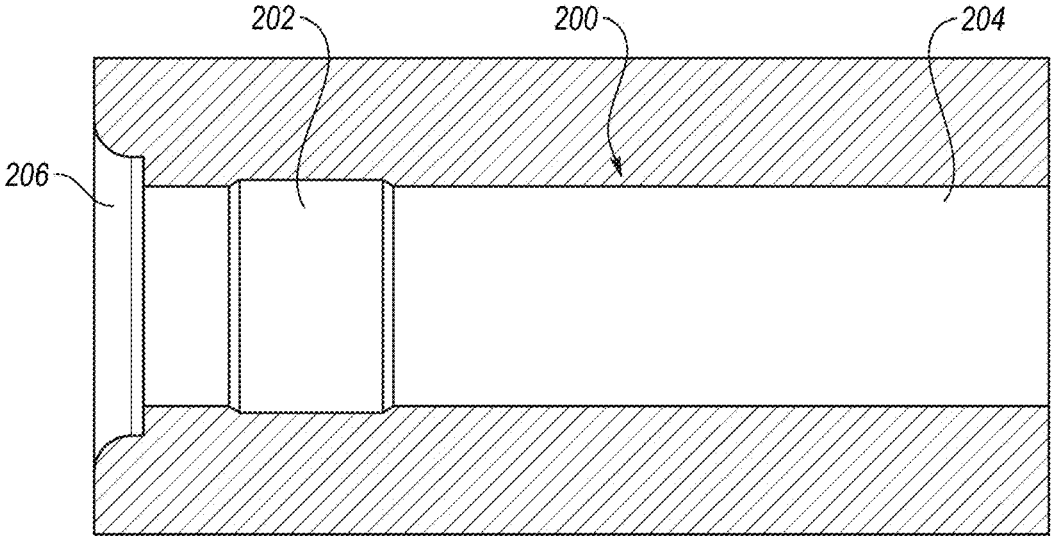
FIG. 2 is cross-sectional side view of a first embodiment of a nozzle cavity in accordance with embodiments of the present disclosure.

FIG. 2 shows a cross-sectional side view of a portion of the bit body including a nozzle cavity 200 in accordance with embodiments of the invention. The nozzle cavity 200 may be disposed at a distal end of a fluid passageway adjacent to an outlet 122 and may be configured to receive a fixed port nozzle 130 (see FIGS. 1A-1C). The nozzle cavity 200 has a first groove 202 that is formed in a cavity wall 204. In the embodiment of FIG. 2, the first groove 202 comprises an annular depression inset into the cavity wall 204. In other embodiments, the first groove 202 may comprise a variety of other shapes or geometries, as illustrated below. In various embodiments, the nozzle cavity 200 also includes an annular ring 206 at the outlet (e.g., outlet 122) to accommodate a flanged nozzle (see, e.g., FIG. 3). In various embodiments, the first groove 202 has a depth of about 0.015" to about 0.062" (e.g., about 0.022"). In various embodiments, the first groove 202 has a width (i.e., a dimension along a longitudinal axis of the nozzle cavity 200) of about 0.100" to about 0.600" (e.g., about 0.350").

Figure 3:
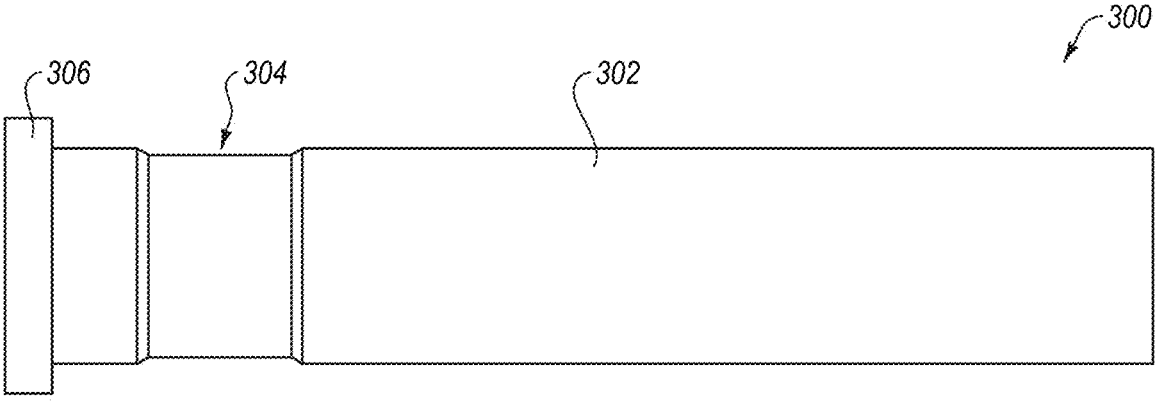
FIG. 3 is a side plan view of a first embodiment of a nozzle in accordance with embodiments of the present disclosure.

FIG. 3 shows a side view of a fixed port nozzle 300 in accordance with embodiments of the invention. The fixed port nozzle 300 may be similar to the fixed port nozzle 130 described above with reference to FIGS. 1A-1C. The fixed port nozzle 300 has a generally cylindrical shape adapted to fit into a nozzle cavity, such as the nozzle cavity 200 shown in FIG. 2. The fixed port nozzle 300 may comprise a nozzle body 302 having a second groove 304 and a flange 306 at an outlet end of the fixed port nozzle 300. The first groove 202 in the nozzle cavity 200 and the second groove 304 on fixed port nozzle 300 are configured to at least partially overlap (e.g., align) when the fixed port nozzle 300 is placed in the nozzle cavity 200 creating an annular ring of open space between the first groove 202 and the second groove 304. In various embodiments, the second groove 304 has a depth of about 0.015" to about 0.062" (e.g., about 0.022"). In various embodiments, the second groove 304 has a width (i.e., a dimension along a longitudinal axis of the fixed port nozzle 300) of about 0.100" to about 0.600" (e.g., about 0.350").

In various embodiments, a method of installing a nozzle into a nozzle cavity (e.g., installing the fixed port nozzle 300 into the nozzle cavity 200) includes applying a liquid sealant, such as an epoxy, to the surfaces of the nozzle cavity and/or nozzle prior to inserting the nozzle into the cavity. In other embodiments, the sealant may be injected into a space between an outer surface of the nozzle and an inner surface of the nozzle cavity after the nozzle is inserted into the nozzle cavity. As the nozzle is inserted into the nozzle cavity, some of the sealant is pushed into the grooves (e.g., the first groove 202 of the nozzle cavity 200 and the second groove 304 of the fixed port nozzle 300) thereby filling the grooves. With the nozzle installed in the nozzle cavity and the sealant in place, the sealant is allowed to cure.

Figure 4:
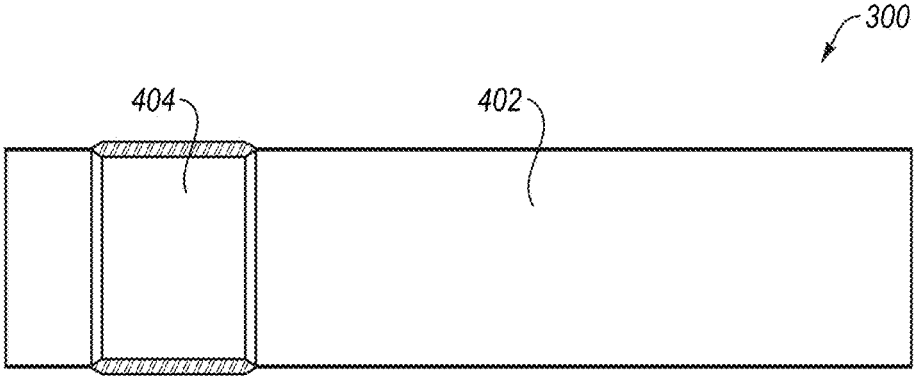
FIG. 4 is a side plan view of a first embodiment of a sealant filling the space between nozzle cavity of FIG. 2 and the nozzle of FIG. 3.

FIG. 4 shows a side view of a cured sealant 400 that would be formed between the fixed port nozzle and the nozzle cavity (e.g., the fixed port nozzle 300 and the nozzle cavity 200). Once the sealant flows into the space between the nozzle cavity 200 and the fixed port nozzle 300 and cures, the cured sealant 400 forms a cylinder 402 between the nozzle cavity 200 and fixed port nozzle 300. The cured sealant 400 also forms a thickened region 404 filling the space formed by the first groove 202 and the second groove 304. The thickened region 404 creates a mechanical bond holding the fixed port nozzle 300 in place in addition to the adhesive bonds between the sealant and the nozzle cavity and nozzle.

Figure 5A:
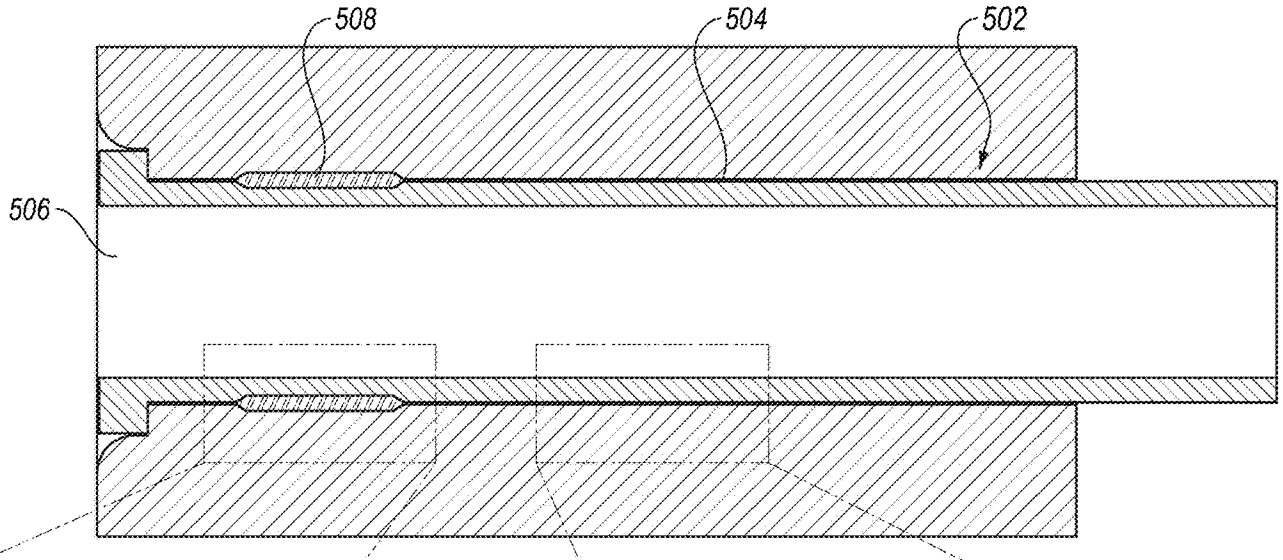
FIG. 5A is a cross-sectional partial side view of a portion of an earth-boring tool showing the nozzle cavity of FIG. 2, nozzle of FIG. 3, and sealant of FIG. 4.

FIG. 5A shows a cross-sectional side view of a fixed port nozzle 506 inserted into a nozzle cavity 502 and fixed within the nozzle cavity 502 via a sealant 508. The nozzle cavity 502 may be similar to the nozzle cavity 200 shown in FIG. 2, the fixed port nozzle 506 may be similar to the fixed port nozzle 300 shown in FIG. 3, and the sealant 508 may be similar to the cured sealant 400 shown in FIG. 4. In various embodiments, the sealant 508 is applied such that it fills substantially all of the space between a cavity wall 504 of the nozzle cavity 502 and an outer surface of the fixed port nozzle 506. The sealant 508 bonds to both the cavity wall 504 and the outer surface of the fixed port nozzle 506. In various embodiments, the sealant 508 is a liquid that solidifies (i.e., cures) after being installed between the cavity wall 504 and the outer surface of the fixed port nozzle 506. For example, the sealant 508 may be an epoxy or a monomer. By way of non-limiting example, the sealant may be a two-part epoxy that is mixed shortly before application to the parts. One such epoxy is the polyethyl amine epoxy marketed under the name BAKERLOK™.

Figure 5C:
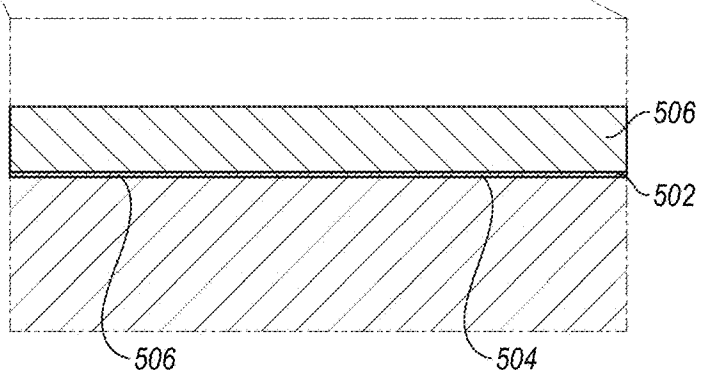
FIG. 5C is an enlarged side cross-sectional view of a portion of the interface between the nozzle cavity and nozzle of FIG. 5A.
Figure 5B:
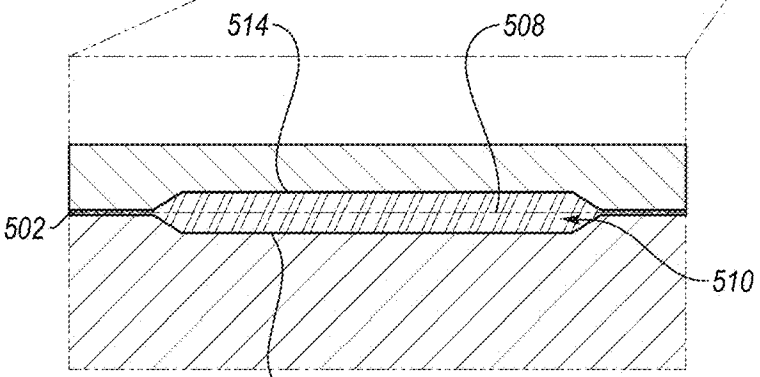
FIG. 5B is an enlarged side cross-sectional view of a portion of the interface between the nozzle cavity and nozzle of FIG. 5A.

FIG. 5B provides an enlarged view of the annular sealant ring 510 formed by the sealant 508 filling the annular space between the first groove 512 of the nozzle cavity 502 and the second groove 514 of the fixed port nozzle 506. The annular sealant ring 510 is configured to create a mechanical lock holding the fixed port nozzle 506 in place within the nozzle cavity 502.

FIG. 5C is an expended view of the interface between cavity wall 504 of the nozzle cavity 502 and an outer surface of the fixed port nozzle 506. In various embodiments, the sealant 508 is a material that adheres to the cavity wall 504 and the outer surface of the fixed port nozzle 506. The sealant 508 is preferably applied in a manner that results in it substantially filling all of the space between cavity wall 504 and the outer surface of the fixed port nozzle 506. This creates a relatively strong bond between the nozzle cavity 502 and the fixed port nozzle 506, thereby holding the fixed port nozzle 506 in place. It also creates a tight seal between the nozzle cavity 502 and the fixed port nozzle 506, preventing the high-pressure drilling fluid from penetrating between the nozzle cavity 502 and the fixed port nozzle 506, which would weaken the bond and reduce the efficacy of the fixed port nozzle 506.

Figure 6A:
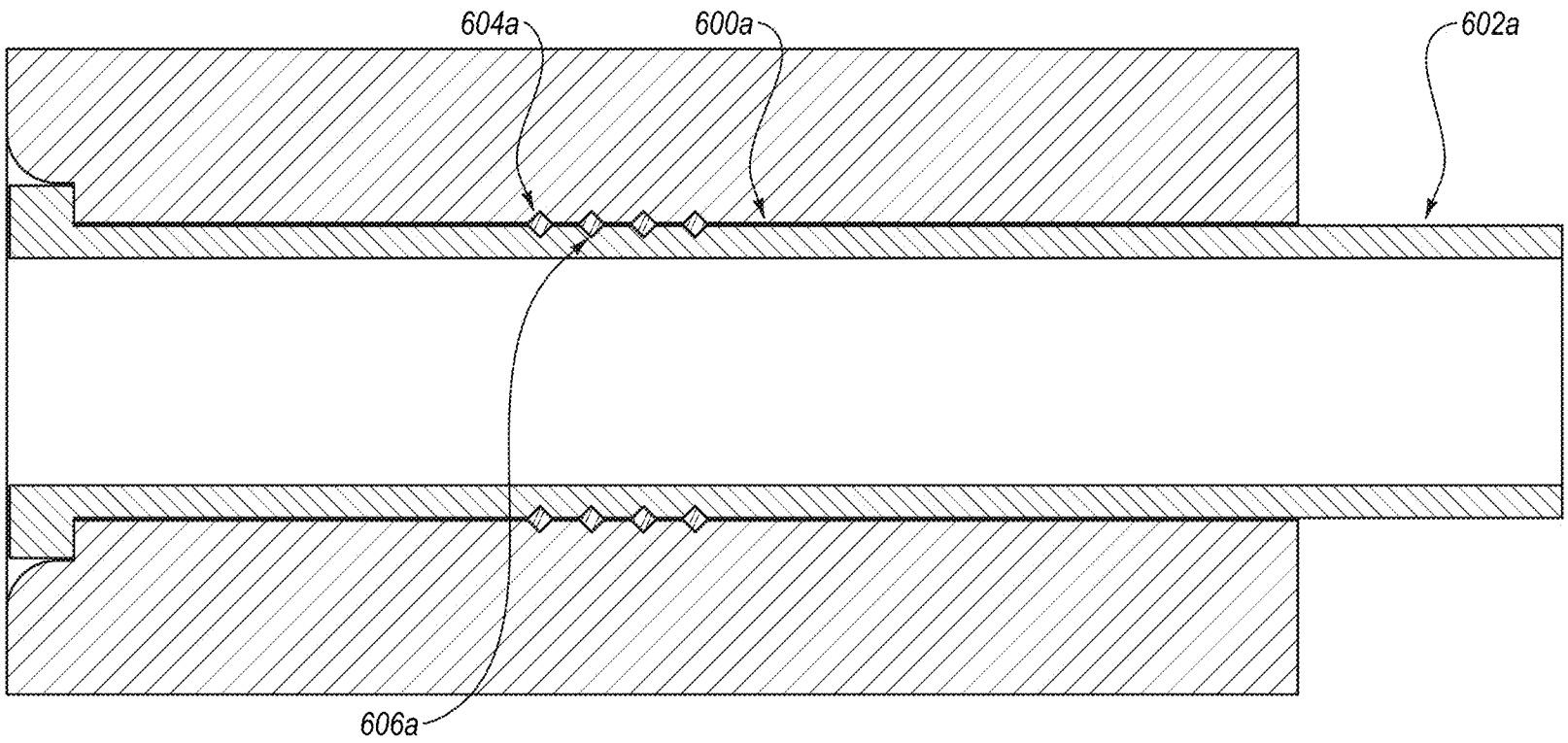
FIG. 6A is a side cross-sectional view of a second embodiment of a nozzle cavity and a nozzle in accordance with embodiments of the disclosure.

FIG. 6A is a cross-sectional side view of a second embodiment of a nozzle cavity 600*a* and a fixed port nozzle 602*a*. The nozzle cavity 600*a* comprises a plurality of first grooves 604*a*, and the fixed port nozzle 602*a* comprises a plurality of second grooves 606*a*. In this embodiment, the first grooves 604*a* and second grooves 606*a* each have a triangular cross-section. Each first groove 604*a* and a corresponding second groove 606*a* may form an annular space between the nozzle cavity 600*a* and the fixed port nozzle 602*a* where the annular space has a quadrilateral shape in cross-section.

In the embodiment if FIG. 6A, the first grooves 604*a* and second grooves 606*a* each have a depth from about 0.015" to about 0.062" (e.g., about 0.022") at a deepest point and width (i.e., a dimension in a direction parallel to a longitudinal axis of the fixed port nozzle 602*a*) from about 0.063" to about 0.250" at a widest point. It is noted that the first grooves 604*a* and the second grooves 606*a* may be placed at any position along the length of the nozzle cavity 600*a* and the fixed port nozzle 602*a*, and the placement of the first grooves 604*a* and second grooves 606*a* shown in FIG. 6A is merely exemplary.

Figure 6B:
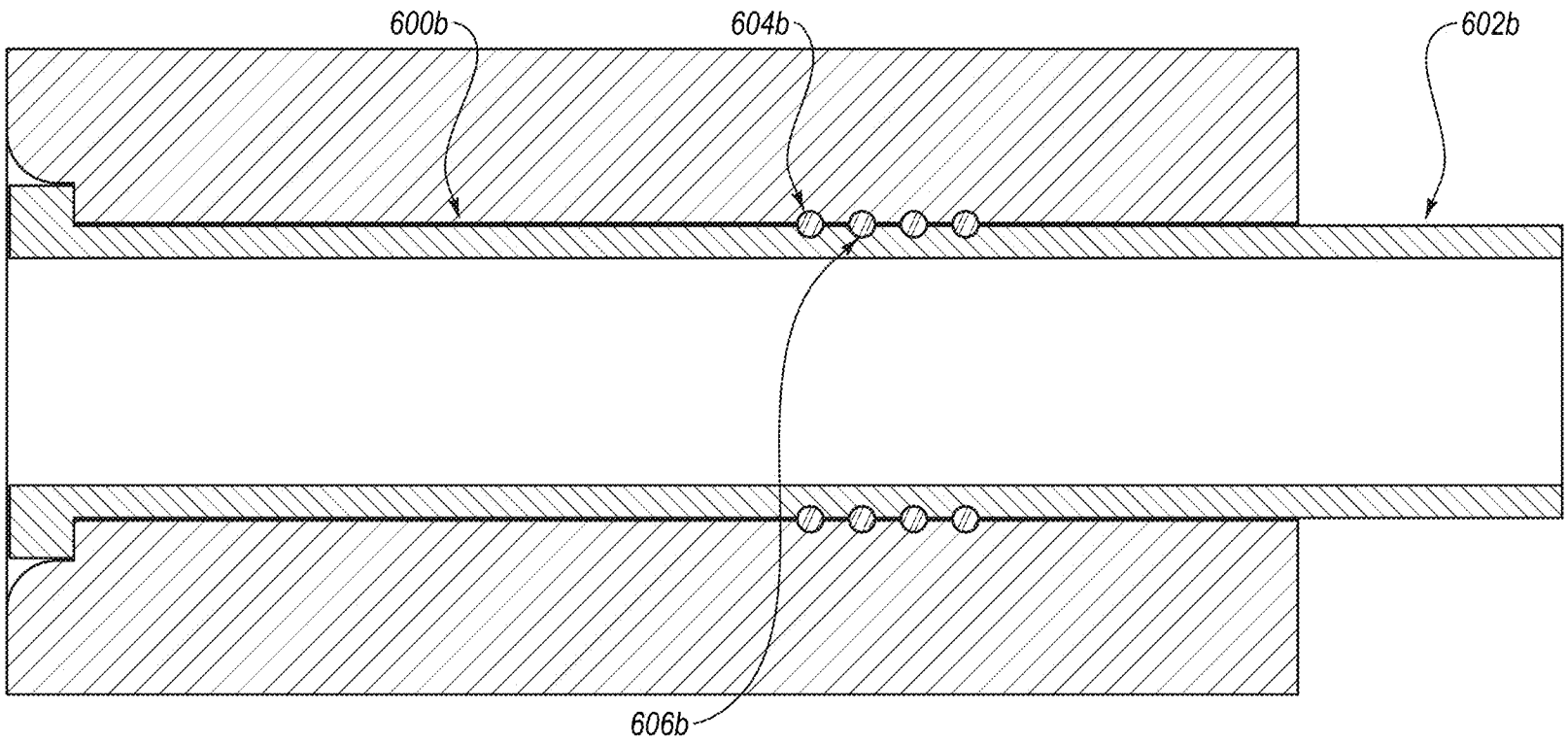
FIG. 6B is a side cross-sectional view of a third embodiment of a nozzle cavity and a nozzle in accordance with embodiments of the disclosure.

FIG. 6B is a cross-sectional side view of a third embodiment of a nozzle cavity 600*b* and a fixed port nozzle 602*b*. The nozzle cavity 600*b* comprises a plurality of first grooves 604*b*, and the fixed port nozzle 602*b* comprises a plurality of second grooves 606*b*. In this embodiment, the first grooves 604*b* and second grooves 606*b* each have a semicircular cross-section. Each first groove 604*b* and a corresponding second groove 606*b* may form an annular space between the nozzle cavity 600*b* and the fixed port nozzle 602*b* where the annular space has a circular shape in cross-section.

In the embodiment if FIG. 6B, the first grooves 604*b* and second grooves 606*b* each have a depth from about 0.015" to about 0.062" (e.g., about 0.022") at a deepest point and width (i.e., a dimension in a direction parallel to a longitudinal axis of the fixed port nozzle 602*b*) from about 0.063" to about 0.250" at a widest point. It is noted that the first grooves 604*b* and the second grooves 606*b* may be placed at any position along the length of the nozzle cavity 600*b* and the fixed port nozzle 602*b*, and the placement of the first grooves 604*b* and second grooves 606*b* shown in FIG. 6B is merely exemplary.

Figure 6C:
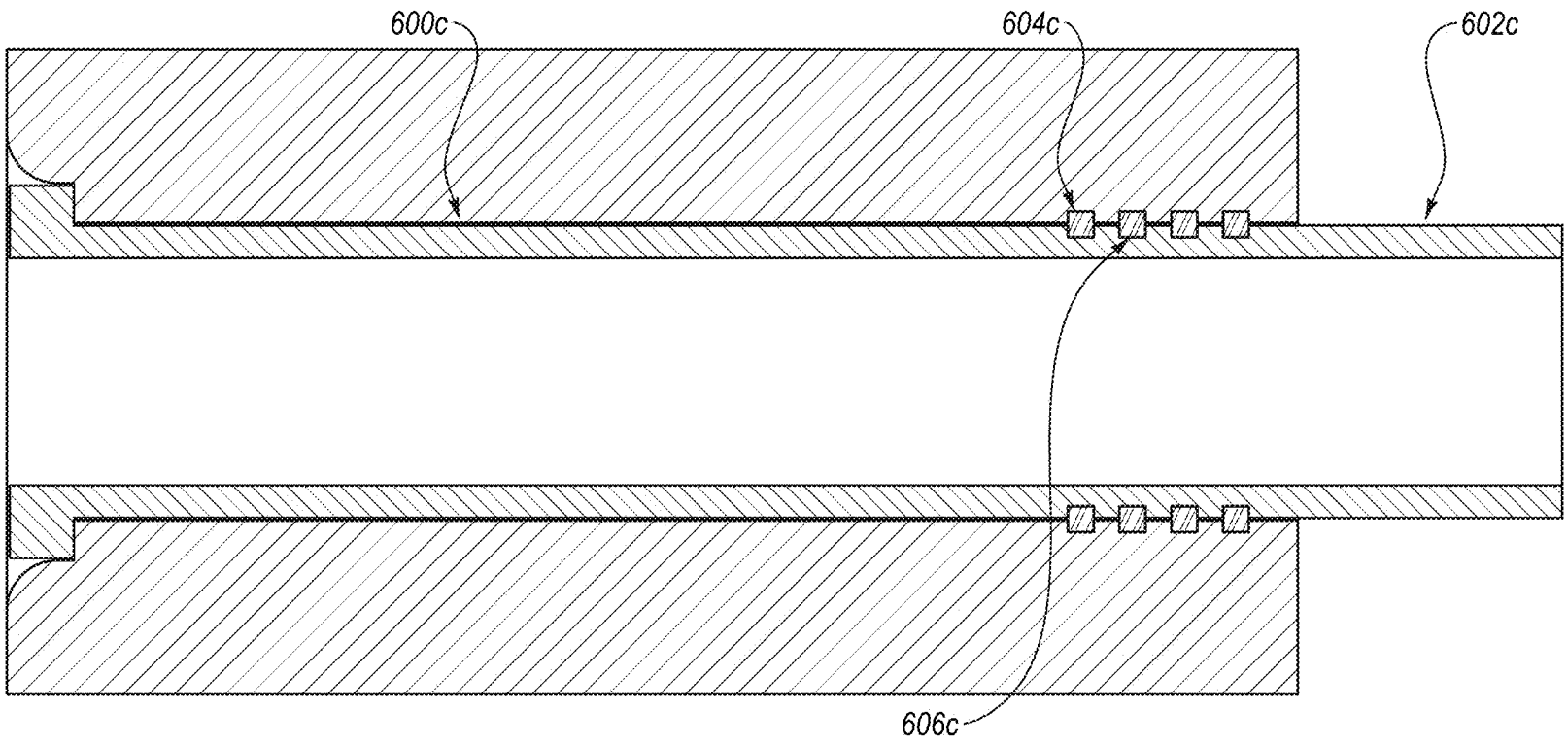
FIG. 6C is a side cross-sectional view of a fourth embodiment of a nozzle cavity and a nozzle in accordance with embodiments of the disclosure.

FIG. 6C is a cross-sectional side view of a fourth embodiment of a nozzle cavity 600*c* and a fixed port nozzle 602*c*. The nozzle cavity 600*c* comprises a plurality of first grooves 604*c*, and the fixed port nozzle 602*c* comprises a plurality of second grooves 606*c*. In this embodiment, the first grooves 604*c* and the second grooves 606*c* have a rectangular cross-section. Each first groove 604*c* and a corresponding second groove 606*c* may form an annular space between the nozzle cavity 600*c* and the fixed port nozzle 602*c* where the annular space has a rectangular shape, such as a square shape, in cross-section.

In the embodiment if FIG. 6C, the first grooves 604*c* and second grooves 606*c* each have a depth from about 0.015" to about 0.062" (e.g., about 0.022") at a deepest point and width (i.e., a dimension in a direction parallel to a longitudinal axis of the fixed port nozzle 602*b*) from about 0.063" to about 0.250" at a widest point. It is noted that the first grooves 604*c* and the second grooves 606*c* may be placed at any position along the length of the nozzle cavity 600*c* and the fixed port nozzle 602*c*, and the placement of the first grooves 604*c* and second grooves 606*c* shown in FIG. 6B is merely exemplary.

Figure 6D:
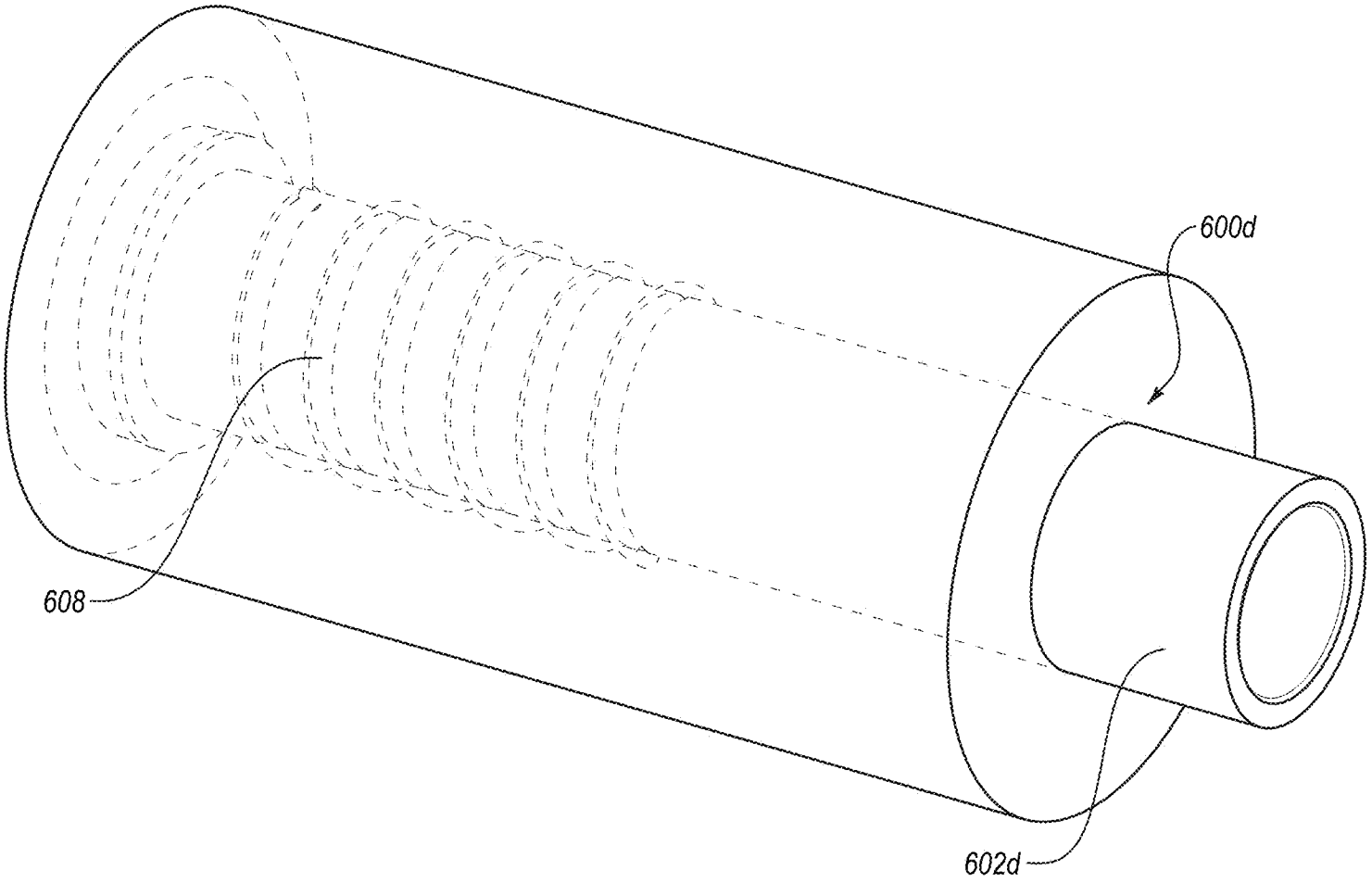
FIG. 6D is a perspective view of a fifth embodiment of an embodiment of a nozzle cavity and nozzle in accordance with embodiments of the present disclosure.
Figure 6E:
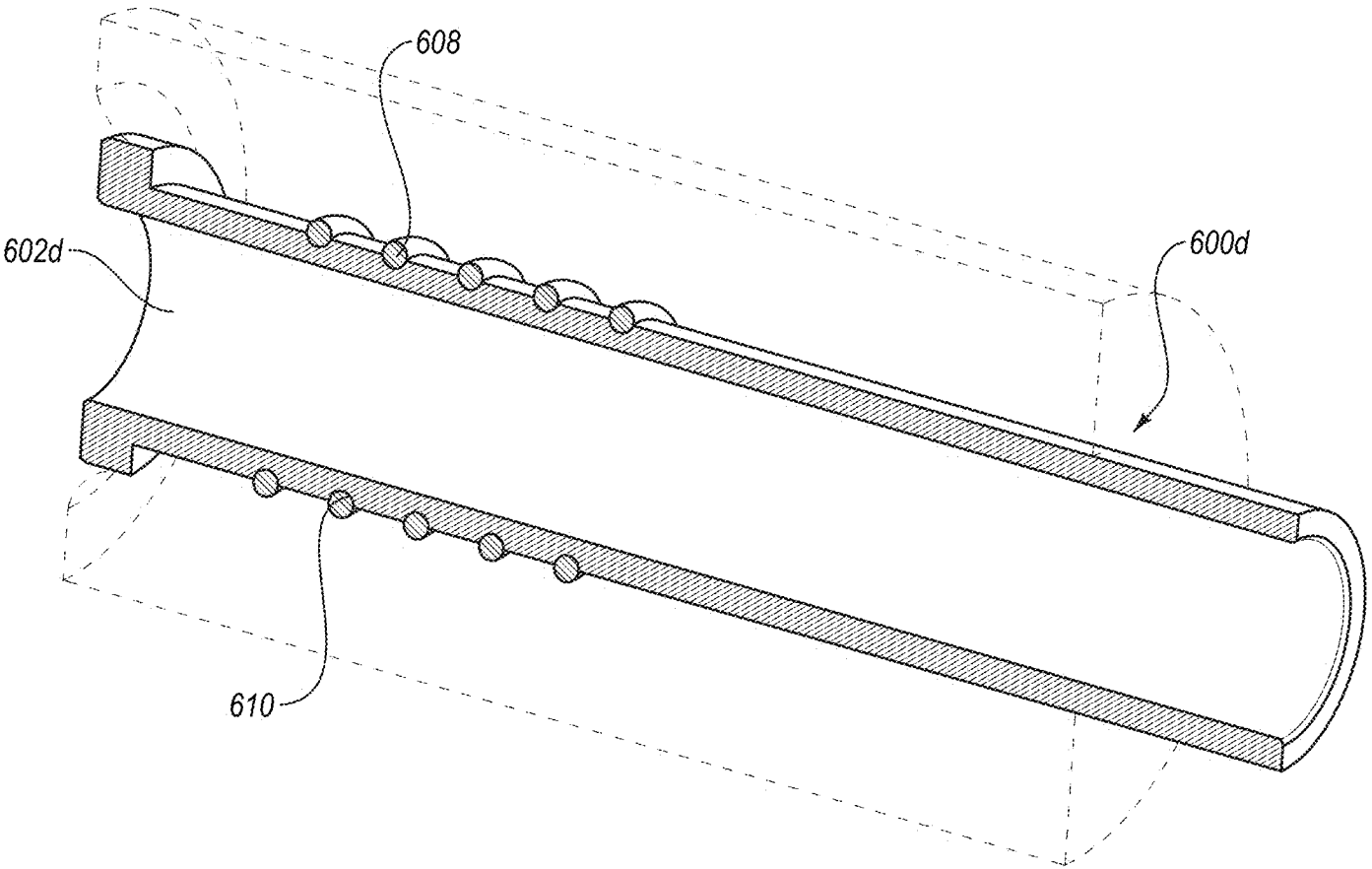
FIG. 6E is a cross-sectional perspective view of the embodiment of FIG. 6D.

FIGS. 6D and 6E illustrate a fifth embodiment of a nozzle cavity 600*d* and a fixed port nozzle 602*d*. The nozzle cavity 600*d* comprises a first groove 608 extending helically along at least a portion of the nozzle cavity 600*d*. The fixed port nozzle 602*d* comprises a second groove 610 that extends helically along at least a portion of the fixed port nozzle 602*d*. When the fixed port nozzle 602*d* is installed into the nozzle cavity 600*d*, the first groove 608 is configured to align with the 610, forming a helical space between the nozzle cavity 600*d* and the fixed port nozzle 602*d*. The first groove 608 and the second groove 610 may each comprise any suitable cross-sectional shape similar to those described above. The helical space formed by the first groove 608 and the second groove 610 may be either a left-handed or a right-handed helix.

In some embodiments, the first groove 608 may be an opposite handed helix as compared to the second groove 610, (e.g., one of the first groove 608 or the second groove 610 is left-handed and the other is right-handed in direction). The first groove 608 and the second groove 610 may intersect at points along each of the first groove 608 and the second groove 610. Persons of ordinary skill in the art will be aware that the pitch of the helical grooves may also be varied.

Although the various embodiments of first grooves and second grooves are shown with a cross-sectional shaping being a mirror-image of a corresponding first groove or second groove, it will be understood by persons of ordinary skill in the art that the geometries of the first grooves and second grooves need not be identical and may include combinations of the shapes shown among others. Likewise, the shape of the grooves is not limited to the shapes shown herein, but may vary widely, including both regular (e.g., symmetrical) and irregular (e.g., asymmetrical) shapes.

Figure 7:
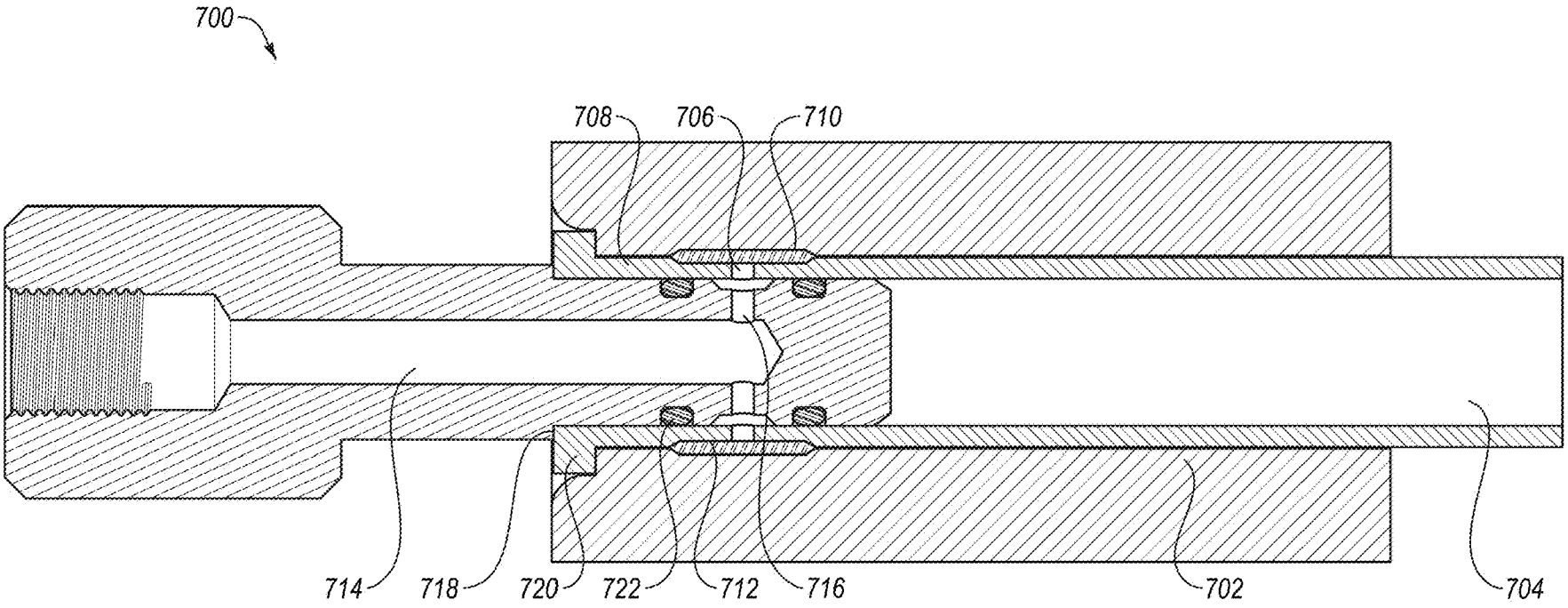
FIG. 7 is a cross-sectional side view of a sealant injector in accordance with embodiments of the disclosure in a nozzle and nozzle cavity.

FIG. 7 is a cross-sectional view of an injector 700 used to inject the sealant between the nozzle cavity 702 and the fixed port nozzle 704. In this embodiment, the fixed port nozzle 704 has one or more channels 706 through the nozzle wall 708. At least one of the channels 706 may be aligned with a first groove 710 of the nozzle cavity 702 and a second groove 712 of the fixed port nozzle 704 such that the at least one channel 706 opens to the space formed between the nozzle cavity 702 and the fixed port nozzle 704 formed by the first groove 710 and the second groove 712, as shown in FIG. 7. The one or more channels 706 may be disposed at a single longitudinal depth in the fixed port nozzle 704, as illustrated in FIG. 7, or may be at different longitudinal depths (e.g., at a longitudinal depth of the first groove 710 and second groove 712 and at another longitudinal depth not aligned with the first groove 710 or the second groove 712).

The injector 700 may be a syringe-type device, or may be configured to couple with a syringe-type device, for pushing the fluid sealant into place. The injector 700 may have a central channel 714 through which the sealant flows. One or more outlets 716 connect to the central channel 714 to inject the sealant at a desired location within the fixed port nozzle 704. For example, the injector 700 is configured such that the outlets 716 align with the channels 706 so that the sealant may flow from the outlets 716 and through the channels 706 to the space between the outer surface of the fixed port nozzle 704 and the nozzle cavity 702.

In some embodiments, the injector 700 comprises a shoulder 718 that is configured to sit on a flange 720 of the fixed port nozzle 704 such that the outlets 716 are aligned with the channels 706. The injector 700 may further comprise O-rings 722 disposed longitudinally on both sides of the outlets 716 to seal against an internal surface of the fixed port nozzle 704. The O-rings 722 may prevent sealant from leaking into inside of the fixed port nozzle 704 and may help direct the sealant through channels 706 and into the space between the fixed port nozzle 704 and the nozzle cavity 702.

Figure 8B:
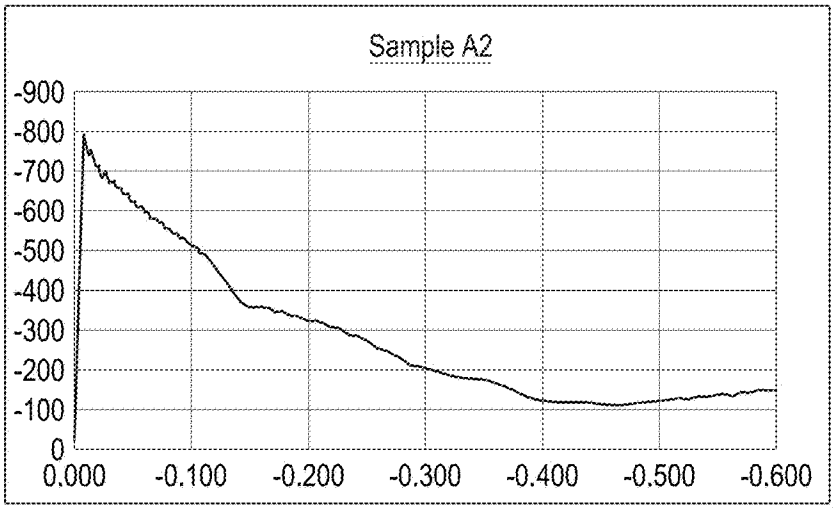
FIG. 8B is another graph of test data of a conventional nozzle cavity and nozzle showing displacement (in.) versus load (lb-f)
Figure 8A:
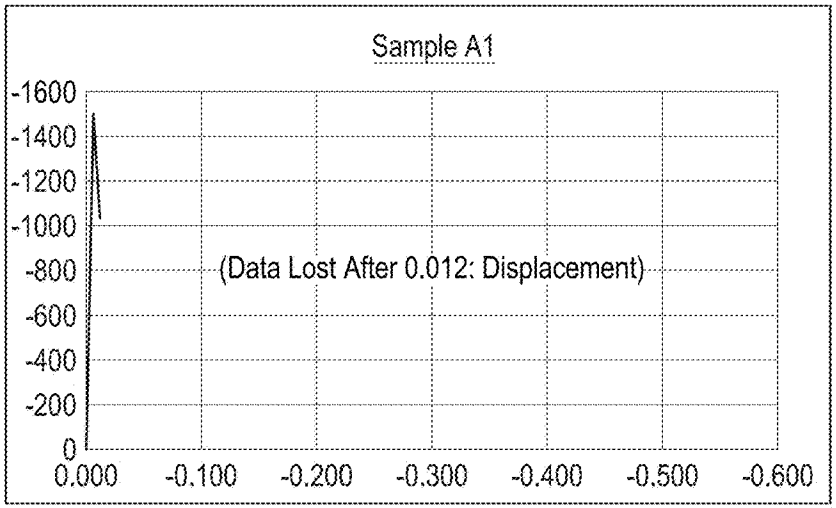
FIG. 8A is a graph of test data of a conventional nozzle cavity and nozzle showing displacement (in.) versus load (lb-f)
Figure 8C:
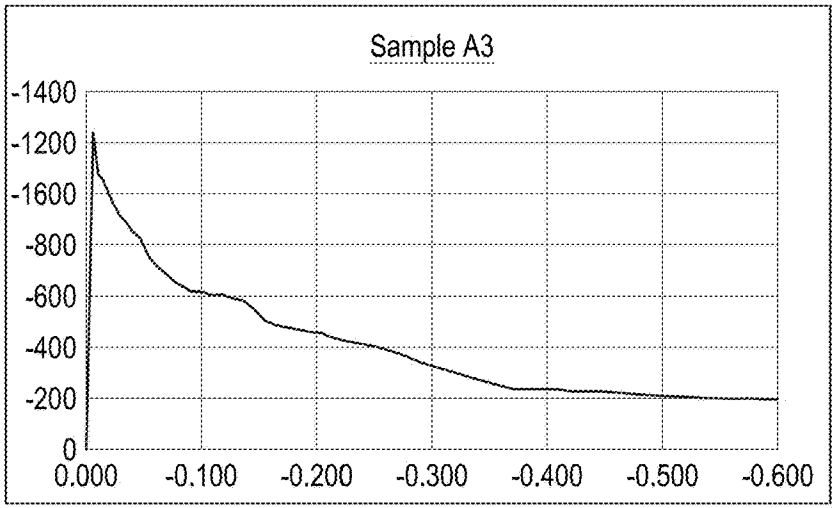
FIG. 8C illustrates an aspect of the subject matter in accordance with one embodiment.

The addition of the first groove and the second groove in the nozzle cavity and the fixed port nozzle provide both a mechanical locking interface between the nozzle cavity and the fixed port nozzle in addition to the bonding provided by the sealant, such as an epoxy. FIGS. 8A to 8C illustrate testing results showing the strength of a bond between a nozzle cavity and a fixed port nozzle formed by sealant alone. Accordingly, the strength of the bond in FIGS. 8A to 8C is based on the adhesion between the sealant and the nozzle cavity, the adhesion between the sealant and the fixed port nozzle, and the shear strength of the cured sealant. In the testing, a nozzle cavity was provided having a straight bore and a cylindrical nozzle was inserted into the nozzle cavity. The nozzle was bonded to the nozzle cavity using BAKERLOK™ as the sealant. The sample tested in FIG. 8A started to fail at about 1500 lb-f. Due to technical issues, no data was obtained after 0.012" displacement. The sample tested in FIG. 8B started to fail at about 800 lb-f. At that point, the nozzle displacement rapidly increased as its ability to bear a load decreased. The sample tested in FIG. 8C didn't start to fail until over 1100 lb-f followed by rapid displacement and total failure of the nozzle. For samples of this type, the average breakaway load was 1170 lb-f and the average persistent load (at 0.600") was 240 lb-f. The equivalent pressures are 2890 psi and 490 psi.

Figure 9A:
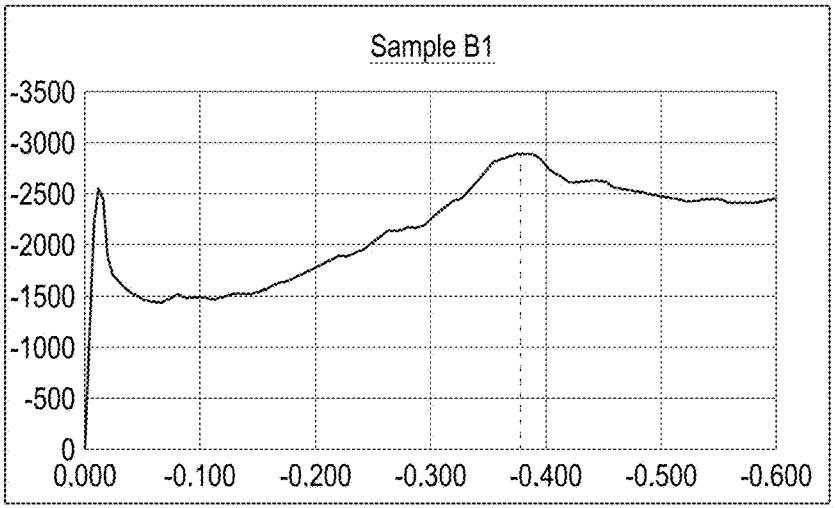
FIG. 9A is a first graph of test data of a nozzle cavity and cavity in accordance with embodiments of the present disclosures showing displacement (in.) versus load (lb-f)
Figure 9C:
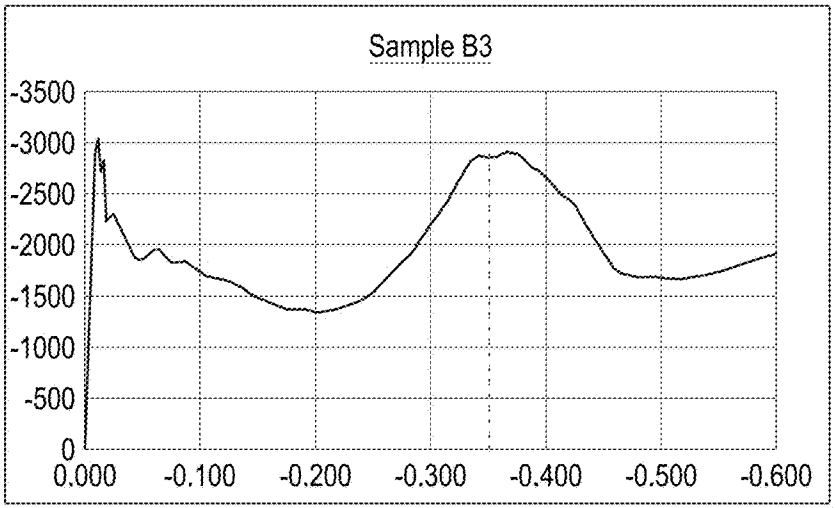
FIG. 9C is a third graph of test data of a nozzle cavity and cavity in accordance with embodiments of the present disclosures showing displacement (in.) versus load (lb-f).
Figure 9B:
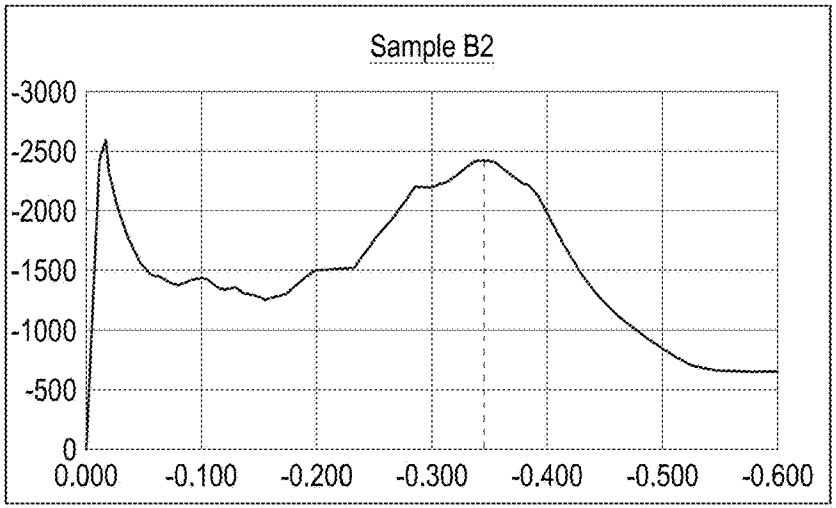
FIG. 9B is a second graph of test data of a nozzle cavity and cavity in accordance with embodiments of the present disclosures showing displacement (in.) versus load (lb-f)

FIGS. 9A to 9C illustrate testing results showing the strength of a bond between a nozzle cavity and fixed port nozzle utilizing the first groove and the second groove to provide an additional mechanical lock between the nozzle cavity and the fixed port nozzle. The samples tested included nozzle cavities and fixed port nozzles with respective first grooves and second grooves such as illustrated in FIGS. 5A to 5C. The sealant used in the samples was BAKERLOK™. The sample in FIG. 9A showed displacement starting at just over 2500 lb-f and a second peak at nearly 3000 lb-f. After some initial displacement of the nozzle, additional force was required before the bond failed and the nozzle was dislodged. The sample in FIG. 9B shows a first peak at just over 2500 lb-f and a second peak at just under 2500 lb-f. The sample in FIG. 9C had a first peak at about 3000 lb-f and a second peak at about 2800 lb-f. For these samples, the average breakaway load was 2840 lb-f and the average persistent load was 1670 lb-f. The equivalent pressures are 7000 psi and 4198 psi. While not being bound to any particular theory, it appears that when the samples are placed under load, compression of the sealant occurs, which may contribute to strengthening the joint as displacement increases.

The embodiments disclosed herein may provide for a more robust bond between a nozzle cavity and a fixed port nozzle as compared to conventional attachments methods, such as brazing. Furthermore, by providing grooves in one or both of the nozzle cavity and an outer surface of the fixed port nozzle, the strength of the bonding interface between the nozzle cavity and fixed port nozzle may be increased based on a mechanical locking effect between the nozzle cavity and the fixed port nozzle.

The attachment between the nozzle cavity and the fixed port nozzle may further provide for relatively easy refurbishment of an earth-boring too, such as a drill bit. For example, during a repair/refurbishment process of a drill bit, temperatures of the drill bit may be elevated, such as above 600° C. At such temperatures, the sealant may break down, such as by becoming a powder like substance, which allows for easy removal of the fixed port nozzle from the nozzle cavity, and easy removal of the sealant from both the fixed port nozzle and the nozzle cavity. Thereafter, the fixed port nozzle may be reinstalled into the nozzle cavity as described above.

The embodiments of the disclosure described above and illustrated in the accompanying drawing FIGURES do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A method of forming an earth-boring tool, comprising:

providing a drill bit body with a nozzle cavity;

forming a first groove in a wall of the nozzle cavity, the first groove formed as a first channel depression inset into the wall and extending around the nozzle cavity, the first groove formed with a first depth;

providing a nozzle adapted to be inserted into the nozzle cavity;

forming a second groove in the nozzle, the second groove formed as a second channel depression inset into a nozzle body of the nozzle, the second groove formed with a second depth;

inserting the nozzle into the nozzle cavity such that the first groove and the second groove are aligned to form a space between the nozzle cavity and the nozzle body;

providing a sealant on the interior of the nozzle cavity and/or the exterior of the nozzle such that the sealant substantially fills the space; and curing the sealant so that the sealant provides a mechanical lock between the nozzle cavity and the nozzle.

2. The method of claim 1, wherein the sealant comprises an epoxy.

3. The method of claim 1, wherein the sealant comprises a monomer and the step of curing the sealant comprises polymerization of the monomer.

4. The method of claim 1, wherein providing a sealant on the interior of the nozzle cavity and/or the exterior of the nozzle further comprises applying the sealant to the interior of the nozzle cavity prior to inserting the nozzle into the nozzle cavity.

5. The method of claim 1, wherein providing a sealant on the interior of the nozzle cavity and/or the exterior of the nozzle further comprises applying the sealant to the exterior of the nozzle prior to inserting the nozzle into the nozzle cavity.

6. The method of claim 1, wherein providing a sealant on the interior of the nozzle cavity and/or the exterior of the nozzle further comprises injecting the sealant into the space between the nozzle cavity and the nozzle.

7. The method of claim 6, further comprising forming a channel through a side of the nozzle, the channel configured to provide an inlet to the space between the nozzle cavity and the nozzle for injecting the sealant.

8. The method of claim 1, wherein:

the first groove comprises a helix; and the second groove comprises a helix.

9. The method of claim 1, wherein:

the first groove has a depth from about 0.015" to about 0.062"; and the second groove has a depth from about 0.015" to about 0.062".

10. The method of claim 1, wherein the first groove comprises a plurality of first grooves in the wall of the nozzle cavity and the second groove comprises a plurality of second grooves in the nozzle.

11. An earth-boring tool, comprising:

a drill bit body having at least one blade and at least one nozzle cavity, the at least one nozzle cavity comprising a generally tubular shape, and the at least one nozzle cavity comprising a first groove that comprises a first depressed channel inset into an interior surface thereof and extending around the nozzle cavity;

a nozzle disposed in the at least one nozzle cavity, the nozzle comprising a generally cylindrical shape and comprising a second groove that comprises a second depressed channel inset into an external surface thereof and extending around the nozzle, the second groove at least partially overlapping the first groove, and the first groove and the second groove forming a space between the nozzle and the at least one nozzle cavity; and a sealant disposed in and substantially filling the space between the at least one nozzle cavity and the nozzle.

12. The earth-boring tool of claim 11, wherein:

the first groove has a depth from about 0.015" to about 0.062"; and the second groove has a depth from about 0.015" to about 0.062".

13. The earth-boring tool of claim 11, wherein:

the first groove has a width from about 0.100" to about 0.600"; and the second groove has a width from about 0.100" to about 0.600".

14. The earth-boring tool of claim 11, wherein:

the first groove comprises a first annular ring; and the second groove comprises a second annular ring.

15. The earth-boring tool of claim 14, wherein the first groove and the second groove each comprise a semicircular cross-sectional shape, and wherein the first groove is aligned with the second groove such that the space formed between the at least one nozzle cavity and the nozzle comprises a circular cross-sectional shape.

16. The earth-boring tool of claim 14, wherein at least one of the first groove and the second groove each comprise a rectangular cross-sectional shape, and wherein the first groove is aligned with the second groove such that the space formed between the at least one nozzle cavity and the nozzle comprises a rectangular cross-sectional shape.

17. The earth-boring tool of claim 11, wherein at least one of the first groove or the second groove comprises a helical shape.

18. The earth-boring tool of claim 17, wherein the first groove and the second groove comprise the helical shape, and wherein the first groove is aligned with the second groove such that the space between the at least one nozzle cavity and the nozzle comprises a helical shape.

19. A drill bit comprising:

a plurality of blades;

cutting elements disposed on the plurality of blades;

fluid courses disposed between the plurality of blades;

a first outlet disposed in a first fluid course of the fluid courses;

a second outlet disposed in a second fluid course of the fluid courses;

a fixed port nozzle disposed in the first outlet, the first outlet defining a nozzle cavity, and the fixed port nozzle being disposed in the nozzle cavity;

a sealant disposed between an outer surface of the fixed port nozzle and an inner surface of the nozzle cavity, the sealant bonding the fixed port nozzle to the nozzle cavity, and the sealant comprising an epoxy or a monomer; and a removeable nozzle disposed in the second outlet, wherein the nozzle cavity comprises a first groove forming a first depressed channel inset into an interior surface thereof;

the fixed port nozzle comprises a second groove forming a second depressed channel inset into an exterior surface thereof, the second groove at least partially overlapping the first groove, the first groove and the second groove forming a space between the nozzle cavity and the fixed port nozzle; and the sealant is disposed within the space, the sealant within the space configured to provide a mechanical lock between the nozzle cavity and the fixed port nozzle.

* * * * *